US005924148A

United States Patent [19]

Flowers, Sr.

[11] Patent Number: 5,924,148

[45] Date of Patent: Jul. 20, 1999

[54] AUTOMATIC HAND WASHING AND DRYING MACHINE

[76] Inventor: Stanley E. Flowers, Sr., P.O. Box 584, Grove Hill, Ala. 36451

[21] Appl. No.: 09/031,376

[22] Filed: Feb. 26, 1998

[51] Int. Cl.[6] ..... A65H 35/00

[52] U.S. Cl. ..... 4/619; 4/623; 4/626; 134/95.2

[58] Field of Search ..... 4/619, 620, 623, 4/625, 626, 628, 639, 640, 650, 653, 668; 134/95.2, 95.3; 607/81, 86

[56] References Cited

U.S. PATENT DOCUMENTS

| | | | |
|---|---|---|---|
| 3,699,984 | 10/1972 | Davis | 134/95.2 |
| 3,918,987 | 11/1975 | Kopfer | 134/95.2 |
| 4,145,769 | 3/1979 | MacFarlane et al. | 4/166 |
| 4,295,233 | 10/1981 | Hinkel et al. | 4/619 |
| 4,336,619 | 6/1982 | Hinkel et al. | 4/619 |
| 4,398,310 | 8/1983 | Lienhard | 4/623 |
| 4,606,085 | 8/1986 | Davies | 4/623 |
| 5,393,299 | 2/1995 | Brettin | 4/650 |
| 5,522,411 | 6/1996 | Johnson | 134/95.2 |
| 5,727,579 | 3/1998 | Chardack | 134/95.2 |

*Primary Examiner*—Charles R. Eloshway
*Attorney, Agent, or Firm*—Joseph N. Breaux

[57] ABSTRACT

An automatic hand washing and drying machine for automatically washing and drying the hands and, optionally, moisturizing the hands. The machine has an enclosed hand washing chamber wherein the housing has a front wall having first and second openings for receiving therethrough the right and left hands of the user. The first and second openings are covered with a first and second flexible rubber gaskets, respectively. The housing further comprises a sloped top wall made of clear and transparent material to allow the user to visually inspect the hand washing and drying processes.

15 Claims, 3 Drawing Sheets

AUTOMATIC HAND WASHING AND DRYING MACHINE

TECHNICAL FIELD

The present invention relates to hand washing and drying devices and, more particularly, to an automatic hand washing and drying machine for automatically washing and drying the hands and, optionally, moisturizing the hands. The machine has an enclosed hand washing chamber wherein the housing has a front wall having first and second openings for receiving therethrough the right and left hands of the user. The first and second openings are covered with a first and second flexible rubber gaskets, respectively. The housing further comprises a sloped top wall made of clear and transparent material to allow the user to visually inspect the hand washing and drying processes.

BACKGROUND OF THE INVENTION

Restrooms in many commercial establishments provide automatic water turn-on and shutoff via a sensor to eliminate the need to turn water faucets on via unsanitary hands and turn off the contaminated water facets to minimize the spread of bacteria or other diseases. The problem with automated water faucets is that they only serve to control the water usage between users since the facilities of the restrooms do not automatically dispense of cleaning fluids. Moreover, to dry the user's hands, the user must touch an activation button of a hand drying machine or utilize the disposable hand towels of the restroom. Therefore, the efforts to minimize the spread of bacteria and other disease with the use of automated water dispensing is futile since the user must touch the cleaning fluid (soap) dispensing device. Additionally, the use of disposable hand towels of the restroom can be wasted if an excessive amount of disposable hand towels are utilized by the user.

Several devices have been patented which are aimed at hand washing and drying devices.

U.S. Pat. No. 5,522,411, issued to Johnson, entitled "HAND WASHING AND DRYING EQUIPMENT UNIT" discloses a portable hand washing and drying unit including a housing having a opening for receiving the hands of the user. The opening of the housing is closed via a door when not in use. The hand washing and drying chamber of the housing is provided with a cleaning liquid reservoir and an electrically powered fan for providing a flow of air to dry the hands. The user manually operates a valve to dispense the cleaning liquid and manually operates a switch to turning on the fan for drying the hands.

U.S. Pat. No. 4,606,085, issued to Davies, entitled "HAND WASHING DEVICE" discloses a electro mechanical-electronic circuit that is provided with time elements which are initiated by the flow of water to dispense of uncontaminated skin degerming products in a proper quantity. The hand washing device has a wash cycle and a rinse cycle and a emollient timer triggered after the rinse cycle to dispense of an emollient.

U.S. Pat. No. 4,398,310, issued to Lienhard, entitled "WASHSTAND DEVICE" discloses a hand washing device which is triggered by a light barrier. The hand washing device comprises a control system for regulating the moistening, washing, rinsing and drying stages of the washing process.

U.S. Pat. Nos. 4,336,619, entitled, "HAND WASHER AND DRIER MOUNTING STRUCTURE" and 4,295,233, entitled "AUTOMATIC HAND WASHER AND DRYER", to Hinkel et al., disclose a hand washing and drying device having a push button device for controlling the automatic delivery of warm water for a predetermined time and a push button device for controlling the automatic delivery of hand drying air for a preselected period of time.

U.S. Pat. No. 4,145,769, issued to MacFarlane et al., entitled "AUTOMATIC HAND WASHING AND DRYING APPARATUS" discloses a hand washing and drying apparatus including a first manually operable control device for causing operation of a solenoid operated valve to deliver hand washing water directly into a bowl for a preselected period of time. A second manually operable control device is provided for causing operation of a forced air drying structure to provide hand drying air to the bowl.

While each of the above hand washing and drying devices function as desired, none of them have an enclosed hand washing chamber wherein the housing has a front wall having first and second openings for receiving therethrough the right and left hands of the user wherein the first and second openings are covered with a first and second flexible rubber gaskets, respectively. Furthermore, the above devices do not provide a housing which further comprises a sloped top wall made of clear and transparent material to allow the user to visually inspect the hand washing and drying processes.

As will be seen more fully below, the present invention is substantially different in structure from that of the prior hand washing and drying devices.

SUMMARY OF THE INVENTION

The preferred embodiment of the automatic hand washing and drying machine of the present invention solves the aforementioned problems in a straight forward and simple manner. What is provided is an automatic hand washing and drying machine for automatically washing and drying the hands and, optionally, moisturizing the hands. The machine has an enclosed hand washing chamber wherein the housing has a front wall having first and second openings for receiving therethrough the right and left hands of the user. The first and second openings are covered with a first and second flexible rubber gaskets, respectively. The housing further comprises a sloped top wall made of clear and transparent material to allow the user to visually inspect the hand washing and drying processes.

The automatic hand washing and drying machine for automatically washing and drying hands of the present invention comprises a housing having a top portion and a bottom portion. The top portion is quasi-triangularly shaped structure comprising: a sloped top wall, a back wall, a first and second side walls shaped in the form of a truncated right-triangularly shaped structure wherein the base of the truncated right-triangularly shaped structure is disposed along said back wall, and a front wall having formed therein first and second semi-circular apertures. The bottom portion comprises a box shaped structure wherein a front wall of said bottom portion has formed therein first and second semi-circular apertures which align with said first and second semi-circular apertures of said front wall of said top portion to form circular openings.

The automatic hand washing and drying machine for automatically washing and drying hands of the present invention further comprises: a wash basin coupled in the interior of said box shaped structure; a water injection system for injecting water in said wash basin; an air injection system for injecting air above said wash basin; a cleaning fluid dispensing system for injecting cleaning fluid in to the user's hands in said wash basin; an electronic eye for detecting the insertion of hands in said wash basin through said circular openings; and a control unit for timing the activation of said water injection system, said air injection system and said cleaning fluid dispensing system in response to the detecting of said electronic eye to carry out a hand washing process and a hand drying process.

In view of the above, an object of the present invention is to provide an automatic hand washing and drying machine which functions to automatically appropriate a predetermined amount of cleaning fluid, water, air and optionally, moisturizer within the hand washing chamber for washing, drying and optionally moisturizing hands.

Another object of the present invention is to provide an automatic hand washing and drying machine having an electronic eye for determining when the hands of the user enter the hand washing chamber wherein, in response to the electronic eye, the hand washing process commences. Furthermore, the automatic hand washing and drying machine comprises a control unit having a timing mechanism for controlling the timed cycles of the hand washing process, the drying process, and the optional moisturizing process wherein the timing mechanism is initiated in response to the determination by the electronic eye.

A further object of the present invention is to provide an automatic hand washing and drying machine which serves to conserve water.

It is a still further object of the present invention to provide an automatic hand washing and drying machine which is designed to provide a machine which eliminates the need for unsanitary hands to touch the cleaning fluid dispensing mechanism; eliminates the need to manually turn water faucets on or off; and, eliminates the need to manually dispense moisturizing fluids in the user's hands, to eliminate the spread of bacteria or diseases in public restrooms.

It is a still further object of the present invention to provide an automatic hand washing and drying machine including a housing having at least a top wall thereof made of a clear transparent material such as plastic or the like. Therefore, the user can visually inspect the interior of the hand washing chamber to position their hands under the dispensing outlets for receiving the cleaning fluid and optionally, a moisturizing fluid.

It is a still further object of the present invention to provide an automatic hand washing and drying machine including a housing providing a hand washing chamber having first and second apertures covered by first and second flexible rubber gaskets, respectively, wherein the first and second flexible rubber gaskets serve to prevent splashing of waster on the user during the hand washing process. The flexible property of the first and second flexible rubber gaskets functions to accommodate comfortably a myriad of user's wrists or forearm sizes therethrough.

It is a still further object of the present invention to provide an automatic hand washing and drying machine including a housing having a openable top portion to permit access into the hand washing chamber for cleaning the wash basin, as needed.

It is a still further object of the present invention to provide a wash basin having right and left hand washing receptacles. The right and left hand washing receptacles are trough shaped and the side walls thereof have coupled thereto water injection jets.

It is a still further object of the present invention to provide air injection jets in said hand washing chamber for expelling warm air. The air injection jets are coupled to the interior side of the top wall of the housing.

In view of the above objects, it is a feature of the present invention to provide an automatic hand washing and drying machine which is relatively simple structurally and simple to manufacture.

Another feature of the present invention is to provide an automatic hand washing and drying machine which is simple to use.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
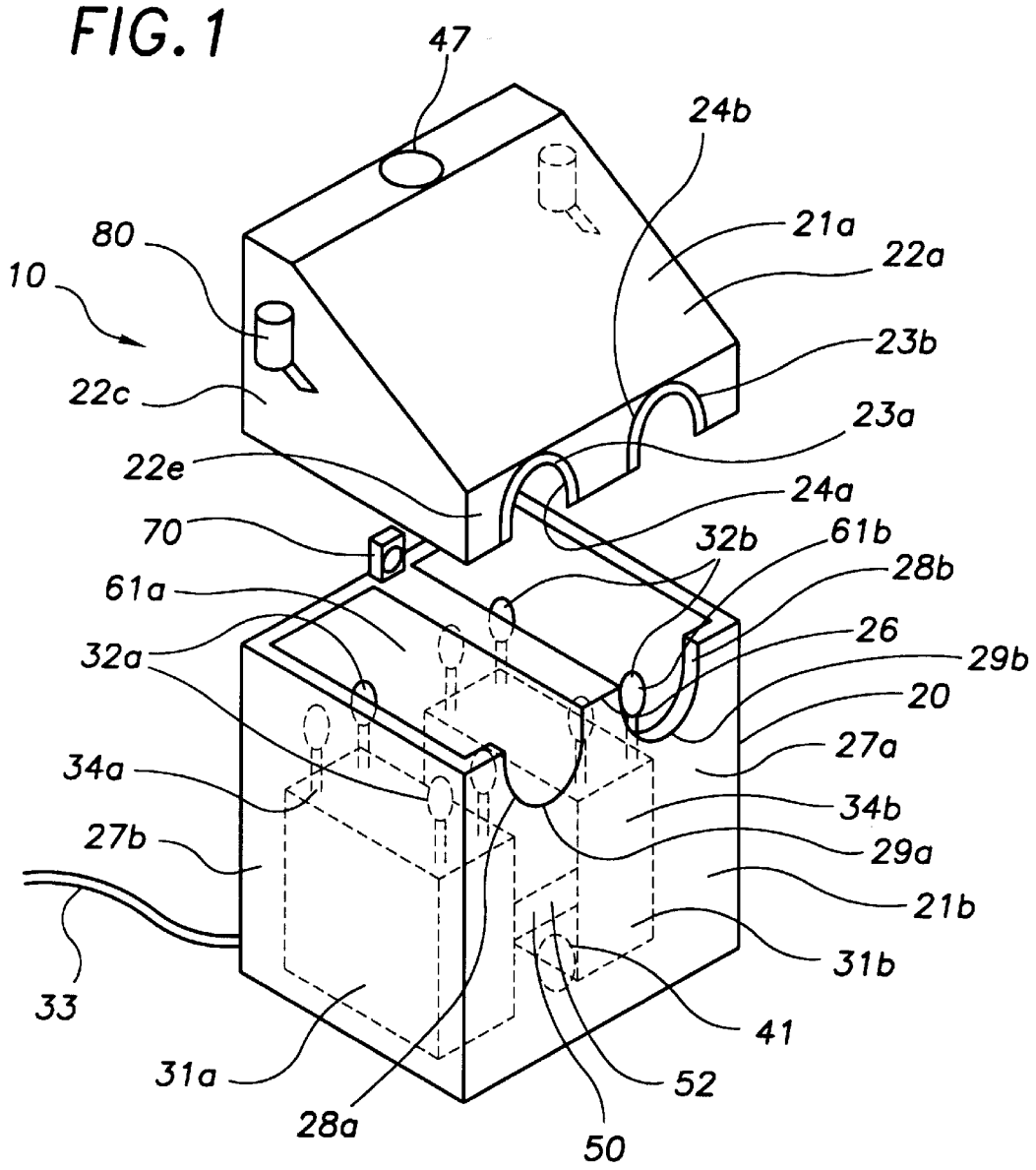
FIG. 1 illustrates a perspective view of the preferred embodiment of the automatic hand washing and drying machine of the present invention having the top portion of the housing raised.
Figure 2:
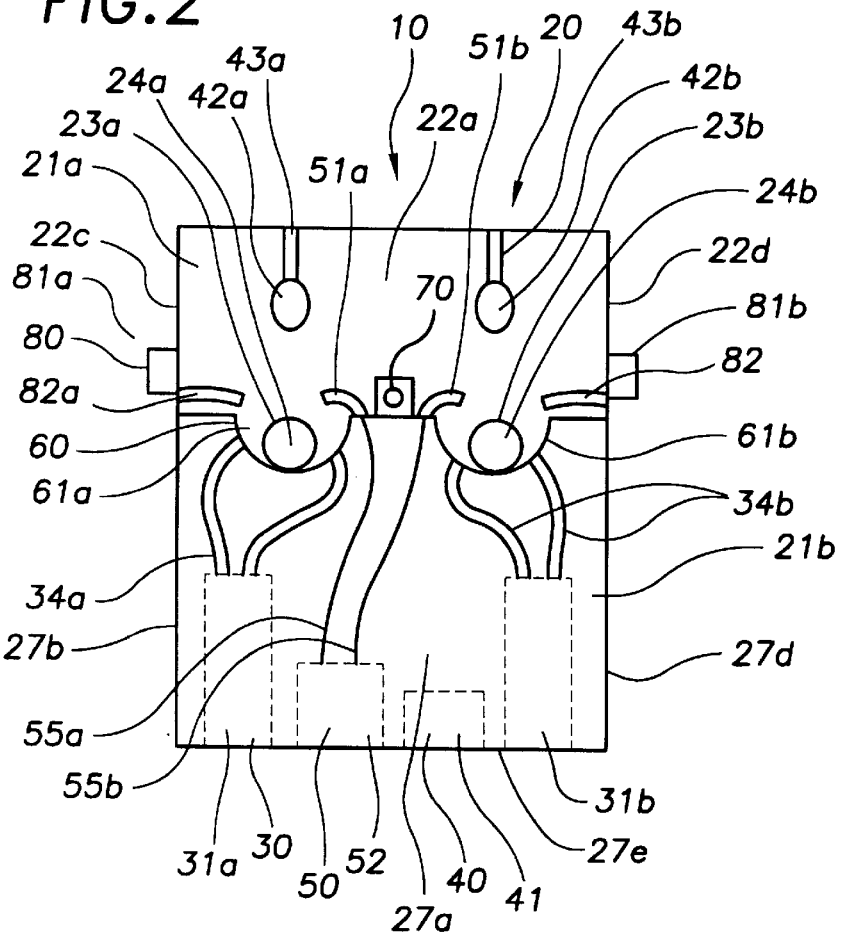
FIG. 2 illustrates a front view of the preferred embodiment of FIG. 1.
Figure 3:
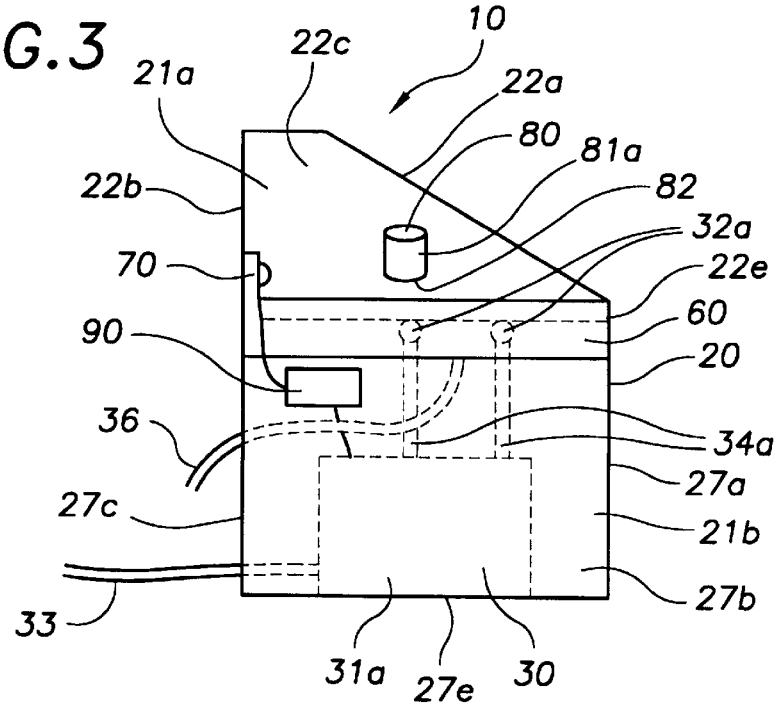
FIG. 3 illustrates a side view of the preferred embodiment of FIG. 1.

Referring now to the drawings, and in particular FIGS. 1–3 and 5, the automatic hand washing and drying machine of the present invention is designated generally by the numeral 10. Automatic hand washing and drying machine 10 is comprised of housing 20, water injection system 30, air injection system 40, cleaning fluid dispensing system 50, wash basin 60, electronic eye 70, optionally, moisturizing fluid dispensing system 80 and control unit 90.

Housing 20 comprises top portion 21*a* and bottom portion 21*b* wherein top portion 21*a* serves as a cover to essentially enclose the hand washing chamber. Bottom portion 21*b* has a top section for coupling therein wash basin 60 and the bottom section below the top section thereof provides a storage compartment for housing the first and second water storage tanks 31*a* and 31*b*, the hot air blower 41, cleaning fluid reservoir 52 and the connecting conduits to wash basin 60. The hand washing chamber is the hollow chamber of housing 20 defined by wash basin 60 and top portion 21*a*.

Top portion 21*a* comprises a top quasi-triangularly shaped structure defined by top wall 22*a*, back wall 22*b*, first and second side walls 22*c* and 22*d* and front wall 22*e*. In the preferred embodiment, at least the top wall 22*a* is made of a clear and transparent material which allows the user to visually inspect the hand washing process taking place within the hand washing chamber. First and second side walls 22*c* and 22*d* are shaped in the form of a truncated right-triangularly shaped structure wherein the base of the truncated right-triangularly shaped structure is disposed along back wall 22*b*. Top wall 22*a* slopes downward from back wall 22*b* to the top edge of wall 27*a* of bottom portion 21*b*. The sloped profile of top wall 22*a* allows the user to visually inspect the hand washing process within the hand washing chamber.

In the preferred embodiment, back wall 22 is hingely coupled to bottom portion 21*b* to allow the top quasi-triangularly shaped structure to rotate upward to permit access to wash basin 60. Thereby, the hand washing chamber and wash basin 60 can be cleaned, as needed. Alternately, the top quasi-triangularly shaped structure may be automatically rotated upward if desired based on actuation of a foot pedal.

Front wall 22*e* has formed therein first and second semi-circular apertures 23*a* and 23*b*, respectively. First and second semi-circular apertures 23*a* and 23*b* are covered by first and second semi-circular flexible rubber gasket portions 24*a* and 24*b*, respectively.

Bottom portion 21*b* comprises a generally box shaped structure having four vertical walls 27*a*, 27*b*, 27*c*, and 27*d*, and a bottom wall 27*e*. In the preferred embodiment, the four vertical walls 27*a*, 27*b*, 27*c*, and 27*d* are made of a material which visually obscures the contents stored within the storage compartment.

The top of vertical wall 27*a* has formed therein first and second semi-circular apertures 28*a* and 28*b* which align with first and second semi-circular apertures 23*a* and 23*b* of first wall 22*e* of top portion 21*a* to form circular openings. First and second semi-circular apertures 28*a* and 28*b* are covered with first and second semi-circular flexible rubber gasket portions 29*a* and 29*b*. First semi-circular flexible rubber gasket portions 23*a* and 29*a* form a gasket for inserting the left hand therethrough. Second semi-circular flexible rubber gasket portions 23*a,b* and 29*a,b* form a gasket for inserting the right hand therethrough. Such gaskets serve to prevent splashing of water on the user during the hand washing process. The flexible feature of the gaskets functions to accommodate comfortably a myriad of user's forearm sizes therethrough.

Figure 4:
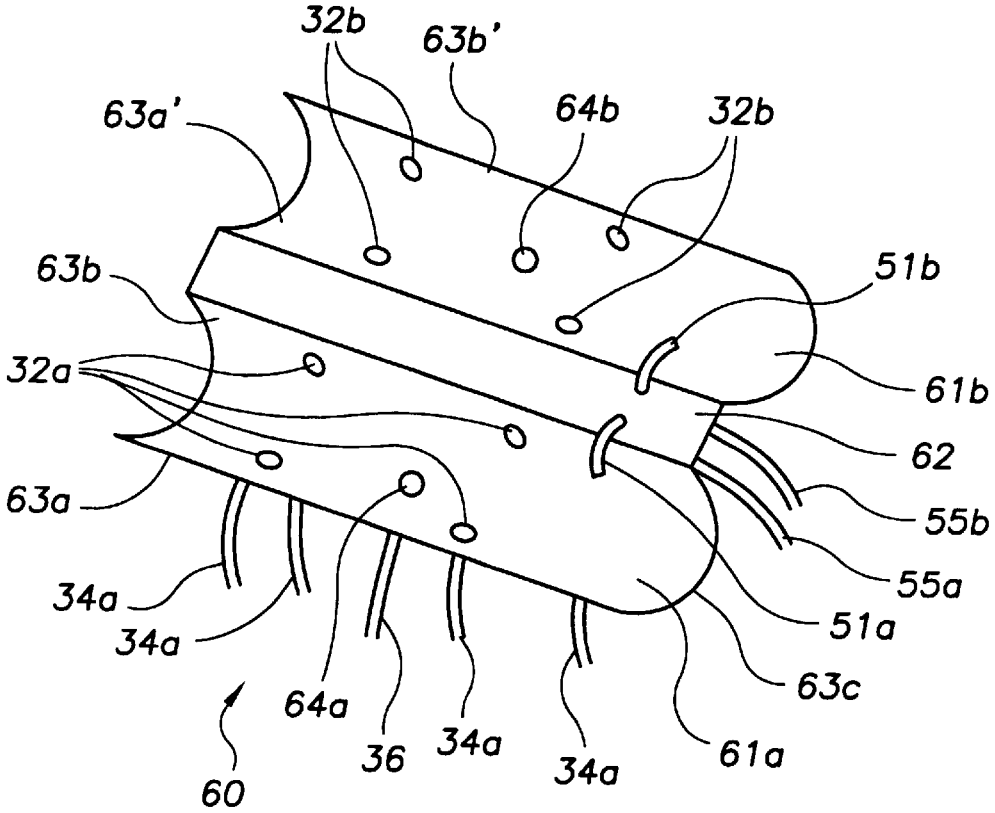
FIG. 4 illustrates a view of the wash basin of the present invention.
Figure 5:
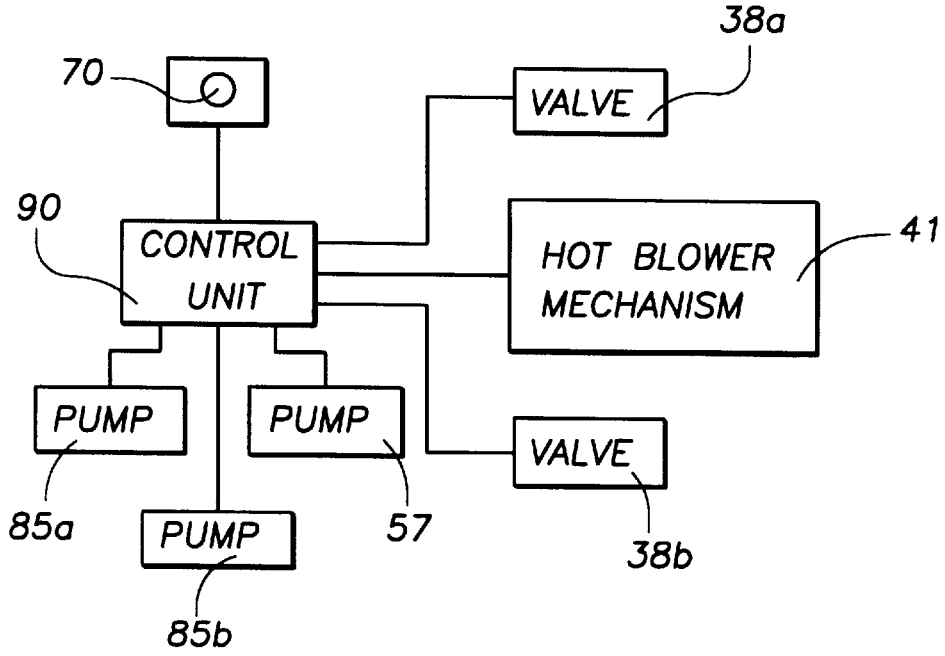
FIG. 5 illustrates block diagram of the connections of the control unit of the present invention for carrying out the hand washing and drying processes and optionally, the moisturizing process.

The top interior of bottom portion 21*b* has coupled thereto wash basin 60. Referring also to FIG. 4, wash basin 60 comprises right and left parallelly aligned hand receptacles 61*a* and 61*b* for receiving the hands of the user therein.

In the preferred embodiment, the right and left parallelly aligned hand receptacles 61*a* and 61*b* are trough shaped. The right and left parallelly aligned hand receptacles 61*a* and 61*b* are separated by spacer 62. Since right and left parallelly aligned hand receptacles 61*a* and 61*b* are identical only one such hand receptacle will be described in detail.

Right hand receptacles 61*a* comprises side walls 63*a* and 63*b* and bottom concaved surface 63*c*. Bottom concaved surface 63*c* has formed therein drain 64*a*. Alternately, bottom concaved surface 63*c* of the trough shaped receptacle may be sloped toward drain 64*a* to facilitate in the rapid flow of the water from right hand receptacle 61*a* to outlet conduit 36 for discarding spent water out of right hand receptacle 61*a*.

The rear of spacer 62 has coupled thereto electronic eye 70. Thereby, as the user inserts their hands within the hand washing chamber via the circular openings, such insertion is detected by electronic eye 70 and the hand washing process commences, preferably, after a first predetermined time. Such first predetermined time allows the user's hand to be fully inserted in the hand washing chamber. During this time period the user should place their hands directly below the cleaning fluid dispensing outlets 51*a* and 51*b*.

Water injection system 30 comprises first and second water storage tanks 31*a* and 31*b* and a plurality of water jets 32*a* positioned along side walls 63*a* and 63*b* of right hand washing receptacle 61*a* and a plurality of water jets 32*b* positioned along side walls 63*a*' and 63*b*' of left hand washing receptacle 61*b*. While the preferred embodiment provides two water storage tanks 31*a* and 31*b*, only one may be provided.

First and second water storage tanks 31*a* and 31*b* receive water via a water line 33 coupled to a water supply such as provided by the public utility. Since first and second water storage tanks 31*a* and 31*b* are identical, only one such water storage tank will be described in detail.

First water storage tank 31*a* comprises a heating element (not shown) for heating the water stored therein to a predetermined temperature and first solenoid activated shutoff valve 38*a* which is controlled by control unit 90. In the preferred embodiment such predetermined temperature forms warm water. First water storage tank 31*a* communicates water to the plurality of water jets 32*a* via a plurality of conduits 34*a*. Likewise, second water storage tank 31*b* communicates water to the plurality of water jets 32*b* via a plurality of conduits 34*b*.

In operation, when electronic eye 70 determines the hands of the user have been inserted, the first shutoff valve 38*a* is opened so that water flows from first water storage tank 31*a* through the plurality of conduits 34*a* to the plurality of water jets 32*a* for a second predetermined time. Likewise, the solenoid activated second shutoff valve 38*b* of second water storage tank 31*a* is opened. Thereby, water flows through the plurality of conduits 34*b* to the plurality of water jets 32*b*. After the second predetermined time, the shutoff valves 38*a* and 38*b* of first and second water storage tanks 31*a* and 31*b* are shut off to shut off the water flowing through the plurality of conduits 34*a* and the plurality of conduits 34*b*, respectively.

Water injection system 30 further comprises outlet conduits 36 coupled to drains 64*a* and 64*b* of right and left hand receptacles 61*a* and 61*b*, respectively for removing spent water therefrom.

Cleaning fluid dispensing system 50 comprises first and second cleaning fluid dispensing outlets 51*a* and 51*b* and cleaning fluid reservoir 52 wherein cleaning fluid reservoir 52 stores therein a source of cleaning fluid or other anti-bacterial agent for cleaning the hands of the user. Cleaning fluid reservoir 52 comprises a pump 57 for dispensing a predetermined amount of cleaning fluid through first and second cleaning fluid dispensing outlets 51*a* and 51*b*. The cleaning fluid is communicated to first and second cleaning fluid dispensing outlets 51*a* and 51*b* coupled to spacer 62 in the hand washing chamber via conduits 55*a* and 55*b*, respectively. The first and second cleaning fluid dispensing outlets 51*a* and 51*b* extend into right and left hand washing receptacles 61*a* and 61*b*, respectively. Thereby, first and second cleaning fluid dispensing outlets 51*a* and 51*b* dispense cleaning fluid to the right and left hands of the user positioned within right and left hand washing receptacles 61*a* and 61*b*.

In operation, after said second predetermined time control unit 90 controls pump 57 of cleaning fluid reservoir 52 to communicate a predetermined amount of cleaning fluid through first and second cleaning fluid dispensing outlets 51*a* and 51*b* via conduits 55*a* and 55*b*, respectively. During a third predetermined time shutoff valves 38*a* and 38*b* are shut off to conserve water. After the third predetermined time for a fourth predetermined time shutoff valves 38*a* and 38*b* are opened to deliver water to wash basin 60 so that the cleaning fluid can be rinsed off of the user's hands.

Air injection system 40 comprises hot blower mechanism 41, left receptacle air jets 42*a*, right receptacle air jets 42*b* and conduits 43*a* and 43*b*. Hot blower mechanism 41 comprises a heating member (not shown) for heating the air. The hot blow or mechanism 41 communicates forced heated air to right and left air jets 42*a* and 42*b* via conduits 43*a* and 43*b*, respectively. In the preferred embodiment, right and left air jets 42*a* and 42*b* are positioned on the interior side of top wall 22*a* of top portion 21*a* of housing 20.

In operation, control unit 90 activates hot blower mechanism 41 during a fifth predetermined time after the fourth predetermined time to dry the excess water from the user's hands.

Air injection system 40 further comprises air vent 47 coupled to top wall 22*a* in close proximity to back wall 22*b* for venting the forced heated air in the hand washing chamber.

Moisturizing fluid dispensing system 80 comprises first and second moisturizing fluid reservoirs 81*a* and 81*b* coupled to the exterior side of first and second side walls 22*c* and 22*d* and moisturizing fluid dispensing outlets 82*a* and 82*b*. First and second moisturizing fluid reservoir 81*a* and 81*b* have coupled thereto first and second moisturizing fluid dispensing outlets 82*a* and 82*b*, respectively. First and second moisturizing fluid dispensing outlets 82*a* and 82*b* are journalled through first and second side walls 22*c* and 22*d* for dispensing moisturizing fluid in the hand washing chamber. First and second moisturizing fluid reservoirs 81*a* and 81*b* comprise pumps 85*a* and 85*b*, respectively, which are activated by control unit 90 during a sixth predetermined time to dispense moisturizing fluid to the hands of the user.

After the sixth predetermined time, control unit 90 resets to the first predetermined time period and waits for the next user. Furthermore, if at any time during the hand washing process or drying process, or optionally, the moisturizing process, electronic eye 70 detects the removal of the user's hands from the hand washing chamber, control unit 90 is reset to the first predetermined time period.

It is noted that the embodiment of the automatic hand washing and drying machine described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An automatic hand washing and drying machine for automatically washing and drying hands comprising:

a housing having a top portion hingedly connected to a bottom portion wherein said top portion is a quasi-triangularly shaped structure comprising:

a sloped top wall, a back wall, first and second side walls shaped in the form of a truncated right-triangularly shaped structure wherein the base of the truncated right-triangularly shaped structure is disposed along said back wall, and a front wall having formed therein first and second semi-circular apertures, and wherein said bottom portion comprises a box shaped structure wherein a front wall of said bottom portion has formed therein first and second semi-circular apertures which align with said first and second semi-circular apertures of said front wall of said top portion when said top portion is closed onto said bottom portion to form circular openings;

a wash basin coupled in the interior of said box shaped structure;

a water injection system for injecting water in said wash basin;

an air injection system for injecting air above said wash basin;

a cleaning fluid dispensing system for injecting cleaning fluid to a user's hands in said wash basin;

an electronic eye for detecting the insertion of the hands in said wash basin through said circular openings; and, a control unit for timing the activation of said water injection system, said air injection system and said cleaning fluid dispensing system in response to the detecting of said electronic eye to carry out a hand washing process and a hand drying process.

2. The machine of claim 1, wherein at least the sloped top wall of said top portion is made of a clear and transparent material which allows the user to visually inspect the hand washing and drying processes taking place.

3. The machine of claim 1, wherein said back wall of said top portion is hingedly coupled to said bottom portion to allow said top quasi-triangularly shaped structure to rotate upward to permit access to said wash basin.

4. The machine of claim 1, wherein said circular openings are covered with first and second flexible rubber gaskets.

5. The machine of claim 1, further comprising a moisturizing fluid dispensing system having first and second reservoirs exteriorly coupled to said first and second side walls of said top portion wherein said first and second reservoirs have coupled thereto outlets journalled through said first and second side walls for dispensing moisturizing fluid to hands in said wash basin and wherein said moisturizing fluid dispensing system is activated by said control unit.

6. The machine of claim 1, wherein the box shaped structure of said bottom portion is made of a material which is visually obscuring.

7. The machine of claim 1, wherein said wash basin comprises right and left parallelly aligned hand receptacles separated by a spacer wherein said spacer has coupled to the rear thereof said electronic eye.

8. The machine of claim 7, wherein said right and left hand receptacles are trough shaped wherein each receptacle of said right and left hand receptacles comprises side walls and a bottom concaved surface wherein said bottom concaved surface has formed therein a drain and wherein said side walls have coupled thereto water jets for expelling water therethrough.

9. An automatic hand washing and drying machine for automatically washing and drying hands comprising:

a housing having a top portion hingedly connected to a bottom portion wherein said top portion is a quasi-triangularly shaped structure comprising:

a sloped top wall made of a clear and transparent material which allows the user to visually inspect the hand washing and drying processes taking place;

a back wall, first and second side walls shaped in the form of a truncated right-triangularly shaped structure wherein the base of the truncated right-triangularly shaped structure is disposed along said back wall, and a front wall having formed therein first and second semi-circular apertures, and wherein said bottom portion comprises a box shaped structure wherein a front wall of said bottom portion has formed therein first and second semi-circular apertures which align with said first and second semi-circular apertures of said front wall of said top portion when said top portion is closed onto said bottom portion to form circular openings;

a wash basin coupled in the interior of said box shaped structure;

a water injection system for injecting water in said wash basin;

an air injection system for injecting air above said wash basin;

a cleaning fluid dispensing system for injecting cleaning fluid to a user's hands in said wash basin;

an electronic eye for detecting the insertion of the hands in said wash basin through said circular openings; and, a control unit for timing the activation of said water injection system, said air injection system and said cleaning fluid dispensing system in response to the detecting of said electronic eye to carry out a hand washing process and a hand drying process.

10. The machine of claim 9, wherein said back wall of said top portion is hingedly coupled to said bottom portion to allow said top quasi-triangularly shaped structure to rotate upward to permit access to said wash basin.

11. The machine of claim 9, wherein said circular openings are covered with first and second flexible rubber gaskets.

12. The machine of claim 9, further comprising a moisturizing fluid dispensing system having first and second reservoirs exteriorly coupled to said first and second side walls of said top portion wherein said first and second reservoirs have coupled thereto outlets journalled through said first and second side walls for dispensing moisturizing fluid to hands in said wash basin and wherein said moisturizing fluid dispensing system is activated by said control unit.

13. The machine of claim 9, wherein the box shaped structure of said bottom portion is made of a material which is visually obscuring.

14. The machine of claim 9, wherein said wash basin comprises right and left parallelly aligned hand receptacles separated by a spacer wherein said spacer has coupled to the rear thereof said electronic eye.

15. The machine of claim 14, wherein said right and left hand receptacles are trough shaped wherein each receptacle of said right and left hand receptacles comprises side walls and a bottom concaved surface wherein said bottom concaved surface has formed therein a drain.

* * * * *